US006305584B1

(12) United States Patent
Dobobrov et al.

(10) Patent No.: US 6,305,584 B1
(45) Date of Patent: Oct. 23, 2001

(54) DISPENSING COVER ASSEMBLY

(76) Inventors: Branco Dobobrov; Jane Pavlov, both of 8203 W. Ballard, Niles, IL (US) 60714

( * ) Notice: Subject to any disclaimer, the term of this patent is extended or adjusted under 35 U.S.C. 154(b) by 0 days.

(21) Appl. No.: 09/414,215

(22) Filed: Oct. 7, 1999

(51) Int. Cl.[7] ..... B65D 5/72

(52) U.S. Cl. ..... 222/568; 220/603; D7/510; D24/47

(58) Field of Search ..... 222/541, 568, 222/521, 182; 220/603; D7/510; D24/47

(56) References Cited

U.S. PATENT DOCUMENTS

| | | | | |
|---|---|---|---|---|
| D. 310,567 | | 9/1990 | Fitzpatrick | D24/47 |
| D. 315,213 | * | 3/1991 | Ohnuki | D24/47 |
| D. 346,932 | | 5/1994 | Cautereels et al. | D7/507 |
| D. 387,247 | * | 12/1997 | Randolph | D7/510 |
| 2,839,229 | | 6/1958 | Scheswohl | 222/567 |
| 3,369,707 | * | 2/1968 | Porter et al. | 222/521 X |
| 4,103,806 | * | 8/1978 | White | 222/182 |
| 4,243,156 | * | 1/1981 | Lobbestael | 222/541 |
| 4,497,422 | | 2/1985 | Klees | 222/482 |
| 4,579,257 | | 4/1986 | Brändlein | 222/192 |
| 4,732,303 | | 3/1988 | Wang | 222/484 |
| 4,925,051 | | 5/1990 | Herbst | 220/90.4 |
| 5,294,018 | * | 3/1994 | Boucher | 220/603 |

* cited by examiner

*Primary Examiner*—Philippe Derakshani
*Assistant Examiner*—Thach H Bui
(74) *Attorney, Agent, or Firm*—Welsh & Katz, Ltd.

(57) ABSTRACT

A dispensing cover assembly for a partially enclosed beverage container. The dispensing cover assembly includes an engagement portion and a spout portion. The engagement portion has a threaded region formed therein. The threaded region is adapted to engage a threaded region on the beverage container. The spout portion has an elongated slit formed therein. The elongated slit has a width and a length, which is substantially longer than the width.

16 Claims, 2 Drawing Sheets

DISPENSING COVER ASSEMBLY

BACKGROUND OF THE INVENTION

The present invention related to a dispensing cover assembly for a partially enclosed container. More particularly, the present invention relates to a dispensing cover assembly that makes it possible to convert an industry-standard beverage container into a spill-resistant beverage container for young children.

To reduce the likelihood of toddlers or young children from spilling their drinks, parents commonly serve beverages to their children in spill-resistant toddler cups. These toddler caps provide a transition between baby bottles and cups or bottles from which adults consume beverages.

To provide the toddler cup with stability, conventional toddler cups typically have a height that is approximately equal to a width of the cup. One such toddler cup is disclosed in Cautereels et al., U.S. Pat. No. D346,932. Alternative configurations that are used to convert a baby bottle into a sipper cup are disclosed in Fitzpatrick, U.S. Pat. No. D310,567 and Randolph, U.S. Pat. No. D387,247.

Conventional toddler cups include a snap-fit lid that has an elongated spout, such as is illustrated in Cautereels et al. The elongated spout provides a transition from the nipple found on a baby bottle to conventional cup, which has no lid. The elongated spout has a width that is substantially smaller than a length of the spout. The spout thereby enables a beverage to the dispensed through the spout in response to a sucking force. However, the spout resists spilling in other situations.

Disadvantages to the common toddler cup include the necessary burdens of carrying the toddler cup when travelling. Additionally, there are spills frequently associated with transferring the beverage from its original packaging material to the toddler cup.

SUMMARY OF THE INVENTION

The present invention is a dispensing cover assembly for a partially enclosed beverage container. The dispensing cover assembly includes an engagement portion and a spout portion. The beverage container has at least one aperture formed therein. The beverage container has a threaded surface proximate the aperture.

The engagement portion has a threaded region formed therein. The threaded region on the engagement portion is adapted to engage the threaded region on the beverage container for attaching the dispensing cover assembly to the beverage container.

The spout has an elongated slit formed therein. The elongated slit has a length and a width. The length is substantially longer than the width.

DETAILED DESCRIPTION OF THE PREFERRED EMBODIMENTS

Figure 1:
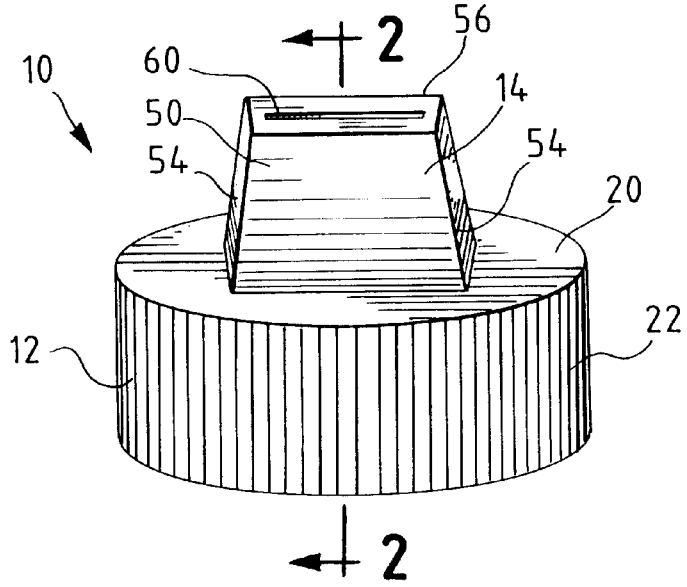
FIG. 1 is a perspective view of a dispensing cover assembly of the present invention.

The present invention is a dispensing cover assembly, as most clearly illustrated at 10 in FIG. 1. The dispensing cover assembly 10 preferably includes an engagement portion 12 and a spout portion 14 that extends from the engagement portion 12.

The dispensing cover assembly 10 of the present invention is adapted for use with industry-standard beverage containers 16 that are typically used to package soft drinks and water. These beverage containers typically have a capacity of between about 10 and 20 fluid ounces. The dispensing cover assembly 10 enables consumers to convert the industry-standard beverage containers into spill-resistant containers for use by toddlers and young children.

The dispensing cover assembly 10 is particularly useful when children are "on the go." The dispensing cover assembly 10 eliminates the need for parents to carry a standard toddler cup. Since it is not necessary to transfer the beverage from the original packaging into the toddler cup, the risk associated with spilling the beverage during such a transfer is also obviated.

The inexpensive nature of the present invention also allows consumers to dispose of the dispensing cover assembly more economically than they could dispose of a conventional toddler cup.

Yet another advantage of the dispensing cover assembly 10 of the present invention is that using the dispensing cover assembly 10 with a conventional beverage container enables the children to feel the sense of accomplishment by being able to drink from a bottle that adults typically drink from rather than the toddler cup or baby bottle.

Figure 2:
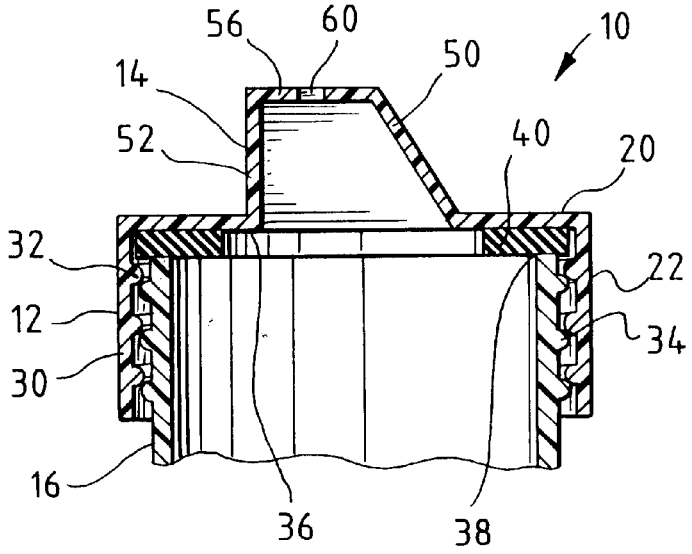
FIG. 2 is a sectional view of the dispensing cover assembly taken along a line 2—2 in FIG. 1.

The engagement portion 12 generally includes a substantially enclosed cap that is defined by a top wall 20 and a side wall 22 extending therefrom, as most clearly illustrated in FIGS. 1 and 2. A diameter of the top wall 20 is about 1.25 inches. A height of the side wall 22 is about 0.50 inches.

An inner surface 30 of the side wall 22 has a threaded region 32 extending from an inner surface thereof. The threaded region 32 is configured to engage a complementary threaded region 34 on a conventional soft drink or water container 16 and thereby removably attach the dispensing cover assembly 10 to the beverage container 16. Removably attaching the dispensing cover assembly 10 to the beverage container 16 enables the dispensing cover assembly 10 to be attached to the bottle 16 when it is desired to dispense a beverage from the beverage container 16. The dispensing cover assembly 10 thereby replaces a conventional cap (not shown) that is placed on the bottle 16 during the manufacturing process to prevent the beverage from being inadvertently dispensed from the beverage container 16 prior to the time at which it is desired to consume the beverage.

Proximate the intersection of the top wall 20 and the side wall 22, the top wall 20 has a substantially flat inner surface 36, as most clearly illustrated in FIG. 2. The substantially flat inner surface 36 is preferably sufficiently wide so that an upper edge 38 of the bottle 16 engages the inner surface 36 when the dispensing cover assembly 10 is attached to the bottle 16. The upper edge 38 thereby substantially flat inner surface 36 provides an additional seal to prevent the beverage from leaking between the threaded regions 32, 34. A width of the inner surface is preferably between about 0.10 and 0.20 inches.

To further reduce the potential for the beverage leaking between the threaded regions 32, 34, the dispensing cover assembly 10 also preferably includes a sealing washer 40 that is positioned adjacent the inner surface 36. The sealing washer 40 is fabricated from a resilient material that deforms when the dispensing cover assembly 10 is attached to the bottle 16.

The spout portion 14 extends from the top wall 20. The spout portion 14 thereby assists a young child in the transition from a baby bottle to conventional bottles that are used to package soft drinks and water. However, similar to the nipple on a baby bottle, the spout portion 14 extends above the top wall 20 so that it is possible to at least partially put the spout portion 14 in the child's mouth, such as is done with the nipple on a baby bottle.

The spout portion 14 preferably includes a front wall 50, a back wall 52, side walls 54, and a top wall 56. The front wall 50, back wall 52, and side walls 54 are preferably configured in a rectangular configuration where the front wall 50 and back wall 52 are longer than the side walls 54.

The top wall 56 is attached to the front wall 50, the back wall 52. and the side walls 54 opposite the top wall 20 so that the top wall 56 encloses a region between these components. The front wall 50 and the back wall 52 each have a length of about 0.60 inches. The side walls 54 have a length of about 0.25 inches. The front wall 50, back wall 52, and side walls 54 each have a height of about 0.50 inches.

The front wall 50 is preferably tapered that a distance between the front wall 50 and the back wall 52 proximate the engagement portion 12 is greater than a distance between the front wall 50 and the back wall 52 opposite the engagement portion 12. Similarly, the side walls 54 are preferably tapered so that a distance between the side walls 54 proximate the engagement portion 12 is greater than a distance between the side walls 54 opposite the engagement portion 12. Such a configuration enables a child to at least partially put the spout portion 14 in the child's mouth while supplying a desirable level of product to be dispensed through the dispensing cover assembly.

The top wall 56 has a slit 60 formed therein. The slit 60 has a length that is substantially greater than a width of the slit 60. The length is preferably about 0.50 inches. The width is preferably about 0.10 inches. The slit 60 thereby provides an egress through which a beverage can be dispensed. However, the long and narrow configuration of the slit 60 minimizes the likelihood that the beverage will be dispensed from the dispensing cover assembly 10 until such time as is desired.

Figure 3:
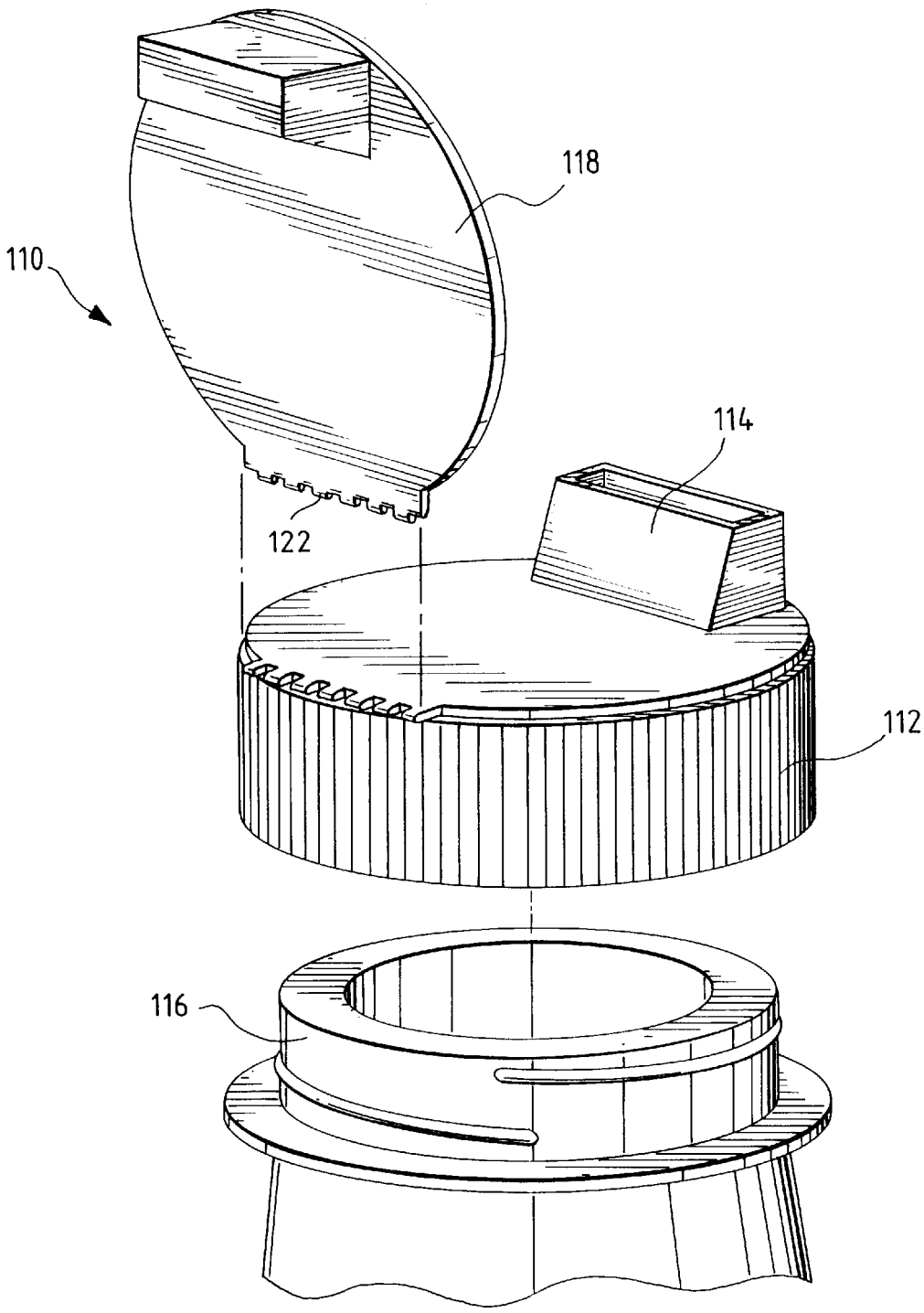
FIG. 3 is a perspective view of an alternative embodiment of the dispensing cover assembly.

In an alternative embodiment, the dispensing cover assembly 110 further includes a lid 118, as most clearly illustrated in FIG. 3. The lid 118 substantially encloses a spout portion 114 and thereby prevents liquid from passing through the dispensing cover assembly 110.

The lid 118 is preferably attached to the dispensing cover assembly 110 with a hinge mechanism 122. The hinge mechanism 122 maintains the lid 118 in attachment with the dispensing cover assembly 110 to thereby prevent loss of the lid 118. The hinge mechanism 122 also preferably allows the lid 118 to be separated from the dispensing cover assembly 110 such as when it is desired to clean the dispensing cover assembly 110.

Use of the lid 118 in conjunction with the dispensing cover assembly 110 also permits the dispensing cover assembly 110 to be attached to a beverage container 116 during the manufacturing process and thereby be shipped to consumers in a "ready-to-use" configuration.

In operation, a cap (not shown) that is placed on the beverage container 16 during manufacturing is rotated with respect to the beverage container 16 to thereby remove the cap from the beverage container 16. The dispensing cover assembly 10 is placed adjacent the threaded region 34 of the beverage container 16 and then rotated so that the threaded region 32 on the dispensing cover assembly 10 engages the threaded region 34 on the beverage container 16, as most clearly illustrated in FIG. 1.

A person who desires to consume the beverage places the spout portion 14 proximate the person's mouth so that the spout portion 14 at least partially extends into the person's mouth. The bottle 16 is then tilted so that a portion of the bottle 16 opposite the dispensing cover assembly 10 is higher than the dispensing cover assembly 10. This movement causes the beverage to be dispensed through the dispensing cover assembly 10.

Depending on the width of the slit 60, it may also be necessary for the person to wrap his or her lips tightly around the spout portion 14 and apply a sucking force to cause the beverage to be dispensed through the dispensing cover assembly 10.

Although the present invention has been described with reference to preferred embodiments, workers skilled in the art will recognize that changes may be made in form and detail without departing from the spirit and scope of the invention.

What is claimed is:

1. A dispensing cover assembly for a partially enclosed beverage container, wherein the beverage container has at least one aperture formed therein, and wherein the beverage container has a threaded surface proximate the aperture, the dispensing cover assembly comprising:

a top wall and circular side walls downwardly depending from the top wall, the side walls having a threaded region formed therein, wherein the threaded region is adapted to engage the threaded region on the beverage container;

the top wall having a diameter substantially less than the diameter of the beverage container;

a spout portion extending from a central portion of the top wall, wherein the spout portion has an elongated slit formed therein, wherein the elongated slit has a length and a width, and wherein the length is substantially longer than the width; and a lid portion configured to substantially enclose the spout portion, the lid pivotally attached to a portion of at least one of the top wall and the side wall.

2. The dispensing cover assembly of claim 1, wherein the engagement portion includes a top wall and a substantially cylindrical side wall extending from the top wall.

3. The dispensing cover assembly of claim 2, wherein the threaded region on the engagement portion is formed in an inner surface of the side wall.

4. The dispensing cover assembly of claim 2, wherein the top wall has a substantially flat inner surface proximate the intersection of the top wall and the side wall.

5. The dispensing cover assembly of claim 1, wherein the spout portion includes a front wall, a back wall, a pair of side walls, and a top wall, wherein the side walls extend between the front wall and the back wall, and wherein the top wall is attached to the front wall, the back wall, and the pair of side walls opposite the engagement portion.

6. The dispensing cover assembly of claim 5, wherein the slit is formed in the top wall.

7. The dispensing cover assembly of claim 1, wherein the slit has a width of about 0.10 inches and a length of about 0.50 inches.

8. A dispensing cover assembly for a partially enclosed beverage container, wherein the beverage container has at least one aperture formed therein, and wherein the beverage container has a threaded surface proximate the aperture, the dispensing cover assembly comprising:

an engagement portion having a top wall and a substantially circular side wall extending from the top wall, wherein an inner surface of the side wall has a threaded region formed therein, and wherein the threaded region is adapted to engage the threaded region on the beverage container;

the top wall having a diameter substantially less than the diameter of the beverage container;

a spout portion extending from central portion of the engagement portion, wherein the spout portion has an elongated slit formed therein, wherein the elongated slit has a length and a width, and wherein the length is substantially longer than the width; and a lid portion configured to substantially enclose the spout portion, the lid pivotally attached to a portion of the engagement portion.

9. The dispensing cover assembly of claim 8, wherein the top wall has a substantially flat inner surface proximate the intersection of the top wall and the side wall.

10. The dispensing cover assembly of claim 8, wherein the spout portion includes a front wall, a back wall, a pair of side walls, and a top wall, wherein the side walls extend between the front wall and the back wall, and wherein the top wall is attached to the front wall, the back wall, and the pair of side walls opposite the engagement portion.

11. The dispensing cover assembly of claim 8, wherein the slit is formed in the top wall.

12. The dispensing cover assembly of claim 8, and further comprising a lid that substantially encloses the spout portion.

13. A dispensing cover assembly for a partially enclosed container, wherein the partially enclosed container has at least one aperture formed therein, and wherein the partially enclosed container has a threaded surface proximate the aperture, the dispensing cover assembly comprising:

an engagement portion having a threaded region formed therein, wherein the threaded region is adapted to engage the threaded region on the partially enclosed container;

the top wall having a diameter substantially less than the diameter of the beverage container;

a spout portion extending from central portion of the engagement portion, wherein the spout portion has a front wall, a back wall, a pair of side walls, and a top wall, wherein the side walls extend between the front wall and the back wall, wherein the top wall is attached to the front wall, the back wall, and the pair of side walls opposite the engagement portion, wherein the top wall has a slit formed therein, wherein the elongated slit has a length and a width, and wherein the length is substantially longer than the width; and a lid portion configured to substantially enclose the spout portion, the lid pivotally attached to a portion of the engagement portion.

14. The dispensing cover assembly of claim 13, wherein the engagement portion includes a top wall and a substantially cylindrical side wall extending from the top wall.

15. The dispensing cover assembly of claim 14, wherein the threaded region on the engagement portion is formed in an inner surface of the side wall.

16. The dispensing cover assembly of claim 14, wherein the top wall has a substantially flat inner surface proximate the intersection of the top wall and the side wall.

* * * * *